United States Patent [19]

Murphy

[11] 3,933,305

[45] Jan. 20, 1976

[54] ASSET VALUE CALCULATORS

[76] Inventor: John Michael Murphy, 104 Lehman Lane, Mill Valley, Calif. 94941

[22] Filed: Aug. 23, 1974

[21] Appl. No.: 499,758

[52] U.S. Cl. ..... 235/70 A

[51] Int. Cl.[2] ..... G06G 1/02

[58] Field of Search ..... 235/70 R, 70 A, 78 F, 85, 235/88 F, 89 R

[56] References Cited

UNITED STATES PATENTS

| | | | |
|---|---|---|---|
| 1,454,104 | 5/1923 | Caldwell | 235/70 R |
| 2,228,403 | 1/1941 | Ross | 235/89 R |
| 2,530,047 | 11/1950 | Dewar | 235/70 R |
| 2,585,595 | 2/1952 | Spencer | 235/70 R |
| 2,657,610 | 11/1953 | Carran | 235/89 R |
| 2,815,172 | 12/1957 | VanArsdale et al. | 235/70 R |
| 2,832,539 | 4/1958 | Blakeley et al. | 235/70 R |
| 3,147,556 | 9/1964 | Prusmack | 235/70 R X |
| 3,814,308 | 6/1974 | Kolan | 235/70 A |

OTHER PUBLICATIONS

Arnold, J. N., "Special Slide Rules," Extension Series No. 32, Engineering Extension Department, Purdue University, Lafayette, Indiana, Sept. 1933, pp. 1–2, 12–13, 19–25, 28, and 31.

*Primary Examiner*—Lawrence R. Franklin

[57] ABSTRACT

A new and novel device for calculating the intrinsic, fair and proper value of real and financial assets according to predetermined mathematical relationships or formulas embodied in the device. The device may take the form of a linear sliding calculator, a slide chart, a rotary disc calculator, or any combination of these. The current market price of the real or financial asset is of incidental or no importance to the calculation of the intrinsic, fair and proper value.

4 Claims, 2 Drawing Figures

ASSET VALUE CALCULATORS

BACKGROUND OF THE INVENTION

A. Field of the Invention

My invention relates to calculating devices and, more particularly, to a new and novel device for calculating the intrinsic, fair and proper value of real and financial assets according to predetermined mathematical relationships or formulas embodied in the device.

The invention may take any of the common forms of a calculating device such as a linear sliding calculator, a slide chart, a rotary disc calculator, or any combination of these.

B. Description of the Prior Art

It is generally not difficult to determine the current market price of either a real asset (such as land, buildings or used machinery) or a financial asset (such as common stocks, bonds or warrants). The owner or potential buyer or seller of an asset can generally refer to recent transactions in identical or similar assets to ascertain the probable market price of the asset in question.

However, it has been very difficult to determine the intrinsic, fair or proper value of an asset, as distinguished from the current market price; yet, such a determination is necessary in order to determine whether the asset is overvalued or undervalued in the marketplace. An asset is overvalued when the current market price is higher than the intrinsic, fair and proper value. An asset is undervalued when the current market price is lower than the intrinsic, fair and proper value.

Heretofore, asset owners have been limited to using the current market price of an asset in relatively simple calculating devices primarily designed to calculate dividend or interest yields, price to earnings ratios, and gains or losses from historical purchase price to current market price.

For example, U.S. Pat. No. 2,572,531, issued to Steinkoenig on Oct. 23, 1951, teaches a slide rule used to calculate dividends on deposits in savings accounts for various periods of time. U.S. Pat. No. 3,209,999, issued to P. R. Carney on Oct. 5, 1965, teaches an analyzing instrument for calculating the price to earnings ratio and the dividend yield of a stock given the current market price, earnings and dividend of the stock. U.S. Pat. No. 3,711,014, issued to J. A. Tucker on Jan. 16, 1973, teaches a record keeping and stock value calculating slide chart for calculating the total current market value and gain or loss from total historical purchase value to current market value of a portfolio of securities, given the current market price of each security.

As can be readily seen, prior art has dealt only with the current market prices of assets and various common calculations related to dividend or interest yield, price to earnings ratios, and gains or losses from historical purchase prices to current market prices. The need is great for my new and novel calculator which provides the asset owner, buyer or seller with the intrinsic, fair and proper value of the asset and, by comparison to the current market price of the asset, a measure of the amount by which the asset is overvalued or undervalued in the marketplace. The current market price of the asset is of incidental or no importance to the calculation of the intrinsic, fair and proper value.

BRIEF SUMMARY OF THE INVENTION

Basically, the primary object of my new and novel invention is to provide a device to calculate the intrinsic, fair and proper value of real and financial assets according to predetermined mathematical relationships or formulas embodied in the device. The invention may take any of the common forms of a calculating device such as a linear sliding calculator, a slide chart, a rotary disc calculator, or any combination of these, and will typically be characterized by a plurality of groups of scales and slides, each group being arranged for the evaluation of a part or a simplification of the predetermined mathematical relationships or formulas. As will be seen below, the predetermined mathematical relationships and formulas determine the markings on the various faces and scales of the calculating device. Consequently, different classes of assets which require different predetermined mathematical relationships to achieve the primary object of the device may have different markings on the various faces and scales of the calculating device in a form appropriate to each class of assets. In any case, each embodiment of the invention will employ a pattern of markings unlike that in which the markings of a conventional slide rule are employed, to achieve a result unique to each embodiment of the invention and impossible of achievement with any known slide rule, conventional or otherwise. This will be especially clear in the case of a mixed formula which cannot be evaluated by continuous manipulation of an ordinary logarithmic slide rule, for instance, a formula including addition or subtraction steps.

A further object of my new and novel invention is to calculate the intrinsic, fair and proper value of real and financial assets according to predetermined mathematical relationships embodied in the device which, in one embodiment, may not require data on any asset or index of assets other than the asset being valued; and, in an alternative embodiment, may require data on an asset or index of assets other than the asset being valued.

A further object of one embodiment of my new and novel invention is to calculate the intrinsic, fair and proper value of common stocks according to a predetermined mathematical relationship which is:

$$FPS = \frac{CPI}{TEI} \times QFS \times \left( \frac{1 + GRS + \frac{NDS}{CPS}}{1 + GRI + \frac{NDI}{CPI}} \right)^{12} \times TES$$

where:

A. *FPS* is the intrinsic, fair and proper value of a stock.
B. *CPI* is the current price of a market index.
C. *TEI* is the last 12 months earnings of the index.
D. *QFS* is the quality factor of the stock.
E. *GRS* is the growth rate of the stock.
F. *NDS* is the normal dividend of the stock.
G. *CPS* is the current market price of the stock.
H. *GRI* is the growth rate of the index.
I. *NDI* is the normal dividend of the index.
J. *TES* is the last 12 months earnings of the stock.

Other objects, advantages and applications of my new and novel invention will become apparent to those skilled in the art of calculating devices when the accompanying description of the preferred embodiment for practicing the invention is read in conjunction with the accompanying drawings.

DETAILED DESCRIPTION OF THE PREFERRED EMBODIMENT OF THE INVENTION

Figure 1:
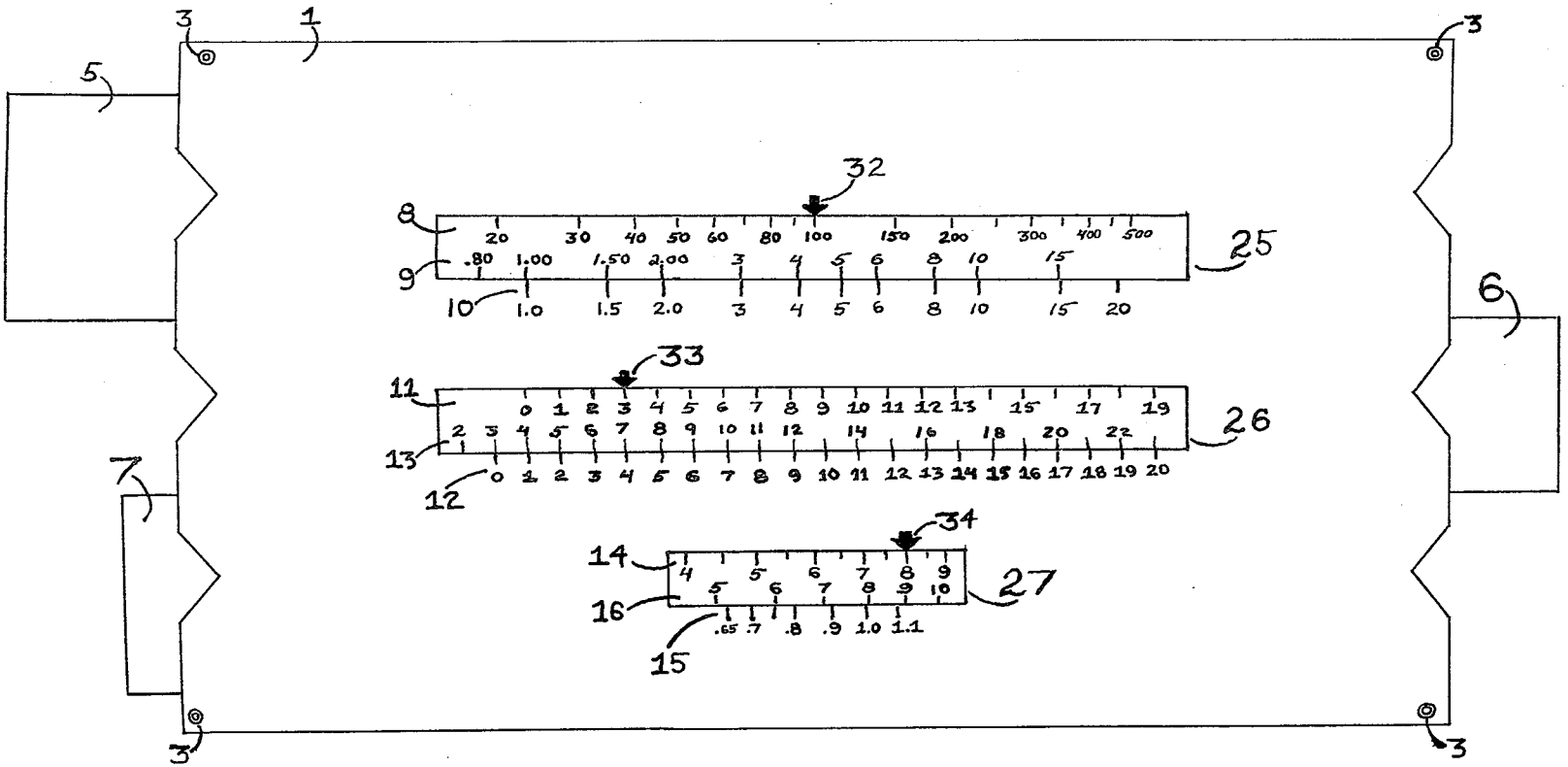
FIG. 1 is a front view of a slide chart embodiment in accordance with this invention, adjusted to perform the first part of the calculation of the intrinsic, fair and proper value of a share of common stock according to the detailed description of the preferred embodiment of the invention, below.

As shown in FIG. 1 of the drawings, a first embodiment of the calculating device in slide chart form of conventional construction teaches an envelope construction with a front face 1 attached to a back face 2 (FIG. 2) by rivets 3 in each of the four corners. Three moveable members 5, 6, 7 slide freely within the envelope with their edges contiguous to each other. A predetermined mathematical relationship is expressed in the form of various logarithmic and arithmetic scales, some of which are printed on the moveable members 5, 6, 7 and some of which are printed on the front face 1 or back face 2 of the slide chart. The scales printed on the moveable members 5, 6, 7 may be read through widows 25, 26, 27 of appropriate shape and position cut into the front face 1 of the preferred embodiment or through windows 28, 29, 30, 31 cut into the back face 2 of the preferred embodiment.

More particularly, FIG. 1 shows the front face 1 of the preferred embodiment adjusted to perform the first part of the calculation of the intrinsic, fair and proper value of a share of common stock. The front of moveable member 5 has printed on it a logarithmic scale 8 to represent the current market value of a share of common stock and logarithmic scale 9 to represent the normal dividend of a share of common stock. In FIG. 1, moveable member 5 has been adjusted to bring the assumed price of the share of common stock, $100, on scale 8 to the read-out marker 32. After locating the assumed normal dividend of the share of common stock, $4.00, on scale 9, the current dividend yield of the stock, 4 percent, can be read opposite the assumed normal dividend on logarithmic scale 10 printed on front face 1 just below window 25.

The front of moveable member 6 has printed on it an arithmetic scale 11 to represent the annual growth rate in earnings of the stock and arithmetic scale 13 to represent the company factor (to be defined below). In FIG. 1, moveable member 6 has been adjusted to bring the assumed annual growth rate in earnings of the stock, 3 percent, on scale 11 to the read-out marker 33. After locating the dividend yield of the stock as calculated above using moveable member 5, 4 percent, on arithmetic scale 12 printed on front face 1 just below window 26, the company factor, 7 percent, can be read on arithmetic scale 13. It will be seen that the company factor is the arithmetic sum of the dividend yield and the growth rate in earnings of the stock.

In the preferred embodiment, the process is repeated a second time to calculate a market factor which is the arithmetic sum of the dividend yield of a stock market index and the growth rate in earnings of the stock market index. For example, if the current market price of the index was also $100, moveable member 5 would be set correctly with $100 onscale 8 opposite read-out marker 32. If the normal dividend of the index was $5.00, locating $5.00 on scale 9 would permit the current dividend yield of the index, 5 percent, to be read on scale 10 opposite the assumed normal dividend of the index.

If the growth rate in earnings of the stock market index was 3 percent, moveable member 6 would be set correctly with 3 percent on scale 11 opposite read-out marker 33. After locating the dividend yield of the index as calculated above using moveable member 5, 5 percent, on arithmetic scale 12, the market factor, 8 percent, can be read on arithmetic scale 13. It will be seen that the market factor is the arithmetic sum of the dividend yield and the growth rate in earnings of the market index.

Clearly, it may be necessary to readjust moveable members 5 and 6 to perform the calculations for different stocks and indices. The assumptions in this description were chosen to make readjustment unnecessary, thus simplifying the teachings.

The front of moveable member 7 has printed on it a scale 14 to represent the market factor calculated above and a scale 16 to represent the company factor calculated above. Scale 15, printed on front face 1 just below window 27, represents the ratio of the company factor to the market factor according to a predetermined mathematical relationship. In the preferred embodiment, the relationship is:

$$\left[\frac{1 + \text{Company Factor}}{1 + \text{Market Factor}}\right]^{12}$$

Thus, in the particular example, moveable member 7 has been adjusted to bring the market factor, 8 percent, on scale 14 opposite read-out marker 34. After locating the company factor, 7 percent, on scale 16 the ratio can be read on scale 15 opposite the company factor. In this case the ratio is:

A. $\left[\frac{1 + \text{Company Factor}}{1 + \text{Market Factor}}\right]^{12}$ B. $\left[\frac{1 + .07}{1 + .08}\right]^{12}$ C. $\left[\frac{1.07}{1.08}\right]^{12}$

D. [0.9907] − .2

E. 0.89

As can be seen, this ratio appears on scale 15 opposite the company factor, 7 percent, on scale 16. It will be appreciated that many possible embodiments may be made of the invention without departing from the scope thereof. For example, the exponent, 12, in the above formula may be greater or lesser. Further, the components and method of calculating the company and market factors may be altered. Also, whereas this preferred embodiment employs a method of determining the intrinsic, fair and proper value of an asset which requires data on an index of similar assets, it will be clear to persons skilled in the art that the predetermined mathematical relationships could be constructed so as not to require data on any other asset or index of assets. For example, the market factor could be replaced by a constant which could be expressed in the device by reading the ratio directly from the company factor shown on arithmetic scale 13.

Figure 2:
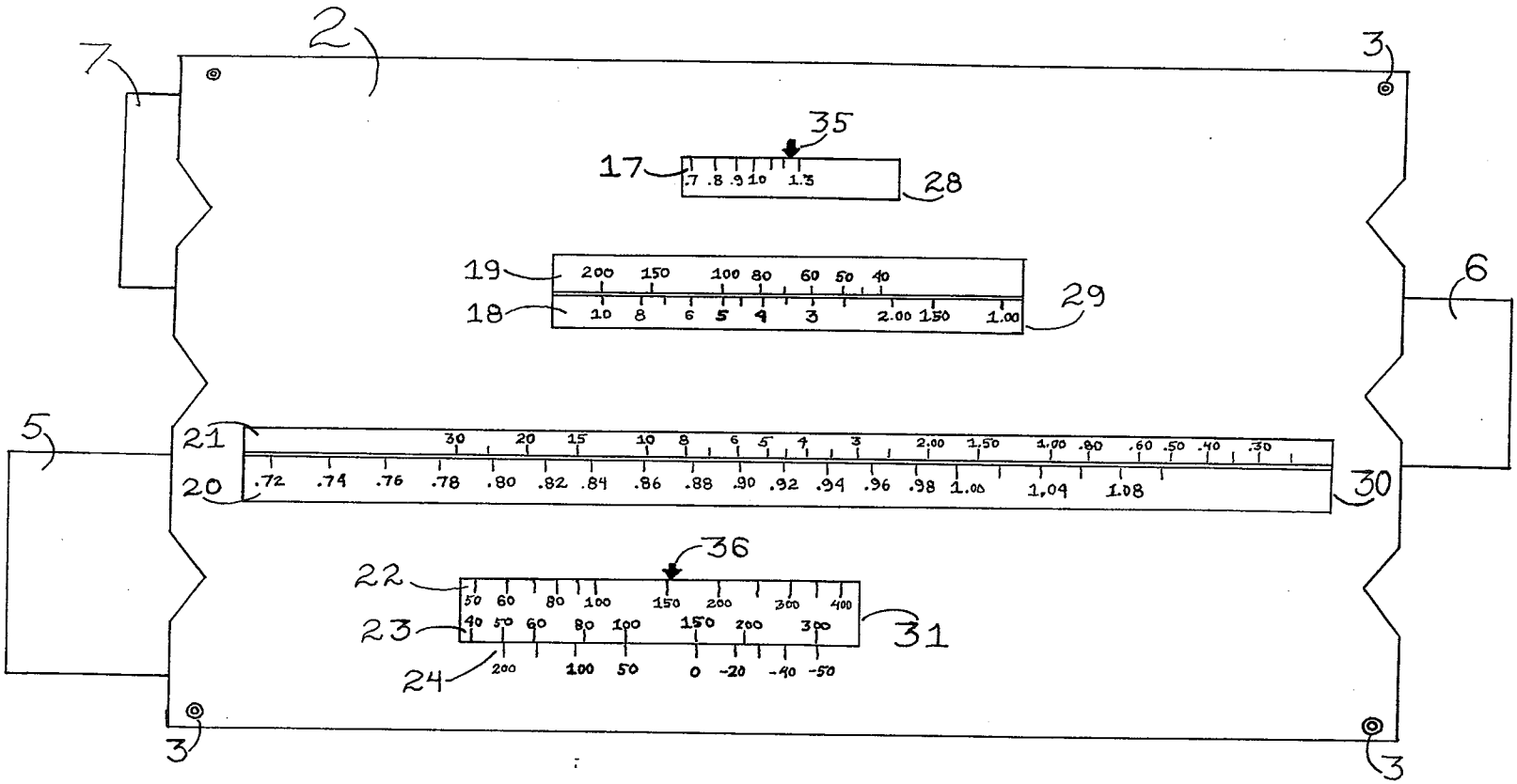
FIG. 2 is a back view of the same slide chart embodiment in accordance with this invention, adjusted to perform the final part of the calculation of the intrinsic, fair and proper value of a share of common stock according to the detailed description of the preferred embodiment of the invention, below.

Turning now to FIG. 2, the back face 2 of the preferred embodiment incorporates four windows 28, 29, 30, 31 through which may be read the various scales printed on the back sides of moveable members 5, 6, 7. Continuing the present example, the moveable members are adjusted to perform the second and final part of the calculation of the intrinsic, fair and proper value of a share of common stock.

The back of moveable member 7 has printed on it a logarithmic scale 17 to represent the stock quality factor and a logarithmic scale 19 to represent the current price of the index. In FIG. 2, moveable member 7 has been adjusted to bring the assumed stock quality factor, 1.25, on scale 17 to the read-out marker 35.

The back of moveable member 6 has printed on it a logarithmic scale 18 to represent the earnings of the index and a logarithmic scale 21 to represent the earnings of the stock. Without moving moveable member 7 from its position previously set, moveable member 6 is adjusted to bring the assumed earnings of the index, $5.00 on scale 18 on moveable member 6, opposite the current price of the index, $100 on scale 19 on moveable member 7.

The back of moveable member 5 has printed on it an arithmetic scale 20 to represent the ratio of company factor to market factor as previously calculated and a logarithmic scale 22 to represent the intrinsic, fair and proper value of a stock and a logarithmic scale 23 to represent the current market price of a stock. Without moving moveable member 6 from its position previously set, moveable member 5 is adjusted to bring the calculated ratio, 0.89 on scale 20 on moveable member 5, opposite the assumed earnings of the stock, $6.90 on scale 21 on moveable member 6.

The intrinsic, fair and proper value of the stock is then read on scale 22 on moveable member 5 opposite read-out marker 36. In this example, the intrinsic, fair and proper value of the stock is $153.50. The predetermined mathematical relationship in the preferred embodiment is:

Intrinsic, fair and proper value of the stock equals
the calculated ratio times
the quality factor times
the price to earnings ratio of the index times
the earnings of the stock.

Thus, in the particular example, the calculated ratio is 0.89, the quality factor is 1.25, the current value of the index is $100, the earnings of the index are $5.00, and the earnings of the stock are $6.90. In this case, the intrinsic, fair and proper value of the stock is:

A. Value = Ratio × Quality Factor × Value of Index-/Earnings of Index × Earnings of Stock
B. Value = 0.89 × 1.25 × 100/5 × $6.90
C. Value = 0.89 × 1.25 × 20 × $6.90
D. Value = 1.1125 × 20 × $6.90
E. Value = 22.25 × $6.90
F. Value = $153.525

Without moving moveable member 5, the assumed current market price of the stock can be located on scale 23. Opposite the assumed current market price, $100, the percentage change from current market price to intrinsic, fair and proper value can be read on logarithmic scale 24, printed on back face 2 just below window 31. The user can thus ascertain if and to what extent the asset is overvalued or undervalued in the marketplace. In this particular example, the asset is undervalued and the intrinsic, fair and proper value of the stock is 53.5 percent higher than the current market price.

It may be noted that in the preferred embodiment the calculated market factor on scale 14 of the front side of moveable member 7 will remain constant if the current market price, normal dividend and growth rate of the index remain constant as is normally the case after the close of each day's trading on the major stock exchanges. Thus, the user need only calculate the market factor once for each session of asset valuation which greatly simplifies the process of determining the intrinsic, fair and proper value of many individual assets such as a portfolio of stocks.

It will be appreciated that the asset value calculator taught by the subject disclosure can also be manufactured in other forms such as a circular slide rule or linear slide rule without departing from the spirit and scope of the invention. It is to be understood that all matters herein set forth or shown in the accompanying drawings are to be interpreted as illustrative and not in a limiting sense. Within the scope of my invention there are many possible variations of the embodiments of my invention which will occur to those skilled in the art in the light of present teachings. It will be understood that certain features and combinations are of utility and may be employed without reference to other features and combinations within the scope of my invention.

From the foregoing, it will be seen that this unique invention is one well adapted to attain all of the ends and objects hereinabove set forth together with other advantages which are obvious and which are inherent to the invention.

Having described my invention, I claim:

1. A device for calculating the intrinsic, fair and proper value of certain financial assets comprising:

a body member consisting of a sleeve having a plurality of windows thereon;
a plurality of slides receivable in said sleeve;
a first index mark adjacent one of said plurality of windows;
a first logarithmic scale on one of said slides denoting a quality factor for said financial asset viewable through said one window;
a second window;
a logarithmic scale along one edge of said first slide denoting the current price of a market index viewable through said second window;
a logarithmic scale along one edge of a second slide denoting the yearly earnings of said market index viewable through said second window, said market index current price scale and said market index yearly earnings scale being juxtaposed so that values on each scale may be aligned by relative motion of said first and second slides;
a third window;
a logarithmic scale along the opposite edge of said second slide denoting the yearly earnings of said financial asset viewable through said third window;
a logarithmic scale along one edge of a third slide denoting the ratio [(1 + company factor) /(1

+ market factor )]$^{12}$ viewable through said third window, said financial assets earning scale and said ratio scale being juxtaposed so that values on each scale may be aligned by relative motion of said second and third slides;

a fourth window;

a second index mark on said sleeve adjacent said fourth window; and a logarithmic scale denoting the fair and proper value of said financial asset on said third slide viewable through said fourth window, whereby known values of financial asset quality factor, market index current price, market index yearly earnings, financial asset yearly earnings, and said ratio may be entered by placing said quality factor opposite said first index mark, said market index yearly earnings opposite said market index price, and said ratio opposite said financial asset yearly earnings, and the fair and proper value of said financial asset may be read out opposite said second index mark.

2. A device according to claim 1 for calculating, in addition, the percentage change from the current price of a financial asset to the intrinsic, fair and proper value of said asset, comprising:

a logarithmic scale denoting the current price of said financial asset along the opposite edge of said third slide viewable through said fourth window; and a logarithmic scale denoting percentage change on said sleeve adjacent to said fourth window, said financial asset current price scale and said percentage change scale being juxtaposed so that when the intrinsic, fair and proper value of said financial asset is set opposite said second index mark, the percentage change from the current price of said financial asset to the intrinsic, fair and proper value of said asset may be read out on said percentage change scale opposite the current price on said current price scale.

3. A device according to claim 1 for calculating, in addition, the said ratio comprising:

said body member having fifth, sixth, and seventh windows thereon;

a third index mark adjacent one edge of said fifth window;

a logarithmic scale on a fourth slide denoting the current price of a financial commodity and being viewable through said fifth window adjacent said third index mark;

a second logarithmic scale on said fourth slide denoting the normal dividend of said commodity and being viewable through said fifth window adjacent the edge opposite said third index mark;

a logarithmic scale on said body member adjacent said fifth window opposite edge denoting the dividend yield of said commodity such that when the current price of said commodity is set opposite said third index mark, said dividend yield may be read out on said dividend yield scale opposite the normal dividend on said normal dividend scale;

a fourth index mark adjacent said sixth window;

a linear scale on a fifth slide denoting the growth rate of said commodity and being viewable through said sixth window adjacent said fourth index mark;

a second linear scale on said fifth slide denoting a commodity factor viewable through said sixth window adjacent the edge opposite said fourth index mark;

a linear scale on said body member adjacent said sixth window opposite edge denoting the dividend yield of said commodity, whereby the commodity factor is read opposite the dividend yield scale when the growth rate is set opposite said fourth index mark;

a fifth index mark adjacent said seventh window;

a pair of commodity factor scales on a sixth slide corresponding to said company factor and said market factor, respectively, viewable through said seventh window; and a logarithmic scale denoting said ratio on said body member adjacent said seventh window, said pair of scales and said ratio scale being relatively located such that when said market factor is set opposite said fifth index mark, the said ratio is opposite said company factor.

4. A device according to claim 3 wherein said fifth, sixth, and seventh windows are on the opposite side of said sleeve from said first, second, third, and fourth windows, and said fourth slide is the opposite side of said third slide, said fifth slide is the opposite side of said second slide, and said sixth slide is the opposite side of said first slide.

* * * * *